United States Patent [19]

Laithwaite

[11] Patent Number: 4,459,206

[45] Date of Patent: Jul. 10, 1984

[54] SEPARATION OF NON-FERROMAGNETIC METALS FROM FRAGMENTED MATERIAL

[75] Inventor: Eric R. Laithwaite, Surbiton, England

[73] Assignee: Cotswold Research Limited, England

[21] Appl. No.: 368,742

[22] Filed: Apr. 15, 1982

Related U.S. Application Data

[63] Continuation of Ser. No. 117,794, Feb. 1, 1980, abandoned.

[30] Foreign Application Priority Data

Feb. 1, 1979 [GB] United Kingdom ..... 7903621

[51] Int. Cl.[3] ..... B03C 1/24

[52] U.S. Cl. ..... 209/3; 209/38; 209/227; 241/79.1

[58] Field of Search ..... 209/629, 636, 212, 213, 209/214, 215, 216, 227, 38, 3; 100/91; 241/79.1; 318/135

[56] References Cited

U.S. PATENT DOCUMENTS

| | | | |
|---|---|---|---|
| 2,971,703 | 2/1961 | Rath | 209/629 X |
| 3,111,484 | 11/1963 | Cavanagh | 209/227 |
| 3,905,556 | 9/1975 | Drage | 241/79.1 X |
| 3,950,661 | 4/1976 | Langmuir | 209/227 X |
| 4,036,441 | 7/1977 | Basten et al. | 241/79.1 X |
| 4,062,767 | 12/1977 | Rudy | 209/212 |
| 4,071,442 | 1/1978 | Morey | 209/212 |
| 4,137,156 | 1/1979 | Morey et al. | 209/227 X |
| 4,229,288 | 10/1980 | Akama | 209/212 |
| 4,362,276 | 12/1982 | Morey | 241/79.1 X |

FOREIGN PATENT DOCUMENTS

| | | | |
|---|---|---|---|
| 659188 | 4/1979 | U.S.S.R. | 209/212 |

*Primary Examiner*—Robert B. Reeves
*Assistant Examiner*—Edward M. Wacyra
*Attorney, Agent, or Firm*—Jones & Askew

[57] ABSTRACT

A system for sorting non-ferromagnetic metals from a mixture of material containing such metals and rubber and plastics material including a conveyor belt system and an associated linear induction motor the frequency and power of operation of which is chosen to deflect selected metals from the conveyor belt. The linear induction motor is placed beneath the conveyor belt and oriented with respect to the conveyor to produce a field of magnetomotive force in which the lines of the magnetic field are at right angles to the direction of motion of the conveyor, and in which the direction of travel of the field is orthogonal to both the lines of force and the direction of motion of the conveyor. The mixture of material subjected to the force of the linear induction motor may initially be treated by presizing or flattening, to enhance the effectivity of the induction motor in separating non-ferromagnetic material.

14 Claims, 12 Drawing Figures

SEPARATION OF NON-FERROMAGNETIC METALS FROM FRAGMENTED MATERIAL

Figure 1:
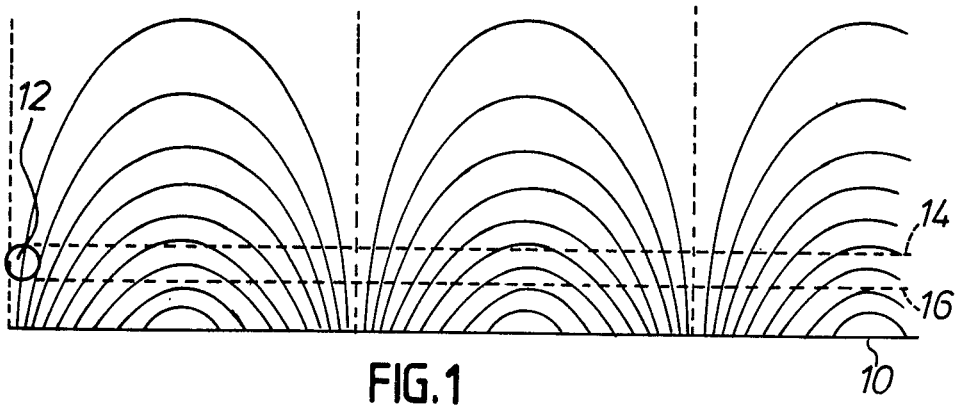
Figure 2:
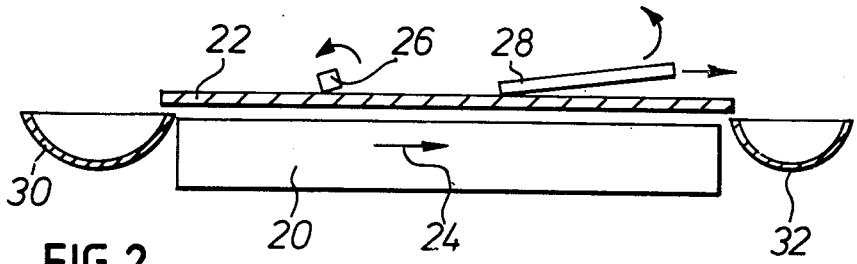

This application is a continuation of application Ser. No. 117,794, filed Feb. 1, 1980 and now abandoned.

This invention relates to the separation of non-ferromagnetic metals from fragmented material and has particular application to the recovery of non-ferromagnetic metals from fragmented scrap.

At present, when objects fabricated from metal, such as cars and domestic appliances, reach the end of their useful life, they are initially crushed and then fed into a so-called fragmentiser in which all parts, including solid metal parts are broken into pieces, the maximum dimension of which is unlikely to exceed about fifteen or twenty centimeters. Wire tends to form itself into tangled ball-like masses but it is unusual for pieces of other material to be trapped in such entanglement. Ferrous metal is extracted from the output of the fragmentiser using a magnetic separator. The remaining material is then commonly hand sorted from a conveyor belt. The ball-like tangles of wire are readily removed but the non-ferrous metal pieces are separated by experienced operatives recognising the objects of which the pieces are broken fragments and knowing, from experience, the metal of which such pieces are commonly made. This is a relatively inefficient procedure and a substantial proportion of the non-ferrous material is not recovered. In addition, it is very labour-intensive.

In the present invention it is proposed to use a linear induction motor to remove non-ferrous metals from mixtures of materials. In the system the mixture of fragmented material is brought into proximity with a linear induction motor primary so that the non-ferrous pieces of material, which act as secondaries to the linear induction motor primary, are displaced out of the rest of the fragmented material.

It is an object of the present invention to provide a metal sorting system in which a linear motor system is used which can economically sort the non-ferromagnetic material from a mixture of non-ferrous scrap. It is also an object of the present invention to provide a metal sorting system which can sort the individual metals such as aluminium, brass, copper etc. into their various categories. It is also an object of the present invention to be able to sort automatically the smaller sizes of non-ferromagnetic material and it is an object to be able to sort the non-ferromagnetic material at a greater rate than the present hand sorting methods.

The present invention therefore provides a metal sorting system including a conveyor belt means for feeding a mixture of non-ferromagnetic material on to said conveyor belt, at a first position, drive means for said conveyor belt to move said conveyor belt at a predetermined speed in a first direction; linear induction motor means situated at a second position along said conveyor belt, said second position being intermediate said first position and the end of the conveyor belt; said linear induction motor means being positioned with the faces of the motor poles adjacent to and substantially underneath said conveyor belt and orientated with respect to said conveyor to produce when actuated a field of magnetomotive force with a component at right angles to said first direction, electrical drive means for said linear induction motor for providing an alternating current supply to said motor at a power level and with a frequency to force, by means of the travelling wave of magnetomotive force produced by said linear motor a percentage of said non-magnetic material from said conveyor, first reception means situated adjacent said linear motor means for receiving non-ferromagnetic material forced from said conveyor belt by the magnetomotive force of said linear motor when actuated; second reception means situated adjacent said conveyor belt at a position downstream from said linear motor induction means for reception of the non-magnetic material remaining on said conveyor belt.

In a first preferred embodiment the linear induction motor means primary member has a toothed core in which the width of each tooth is less than 30% of the tooth pitch.

With such a linear induction motor primary, it is essential for substantially all pieces of ferrous metal to have been extracted from the mixture before it is applied to the conveying means of the invention because the linear induction motor primary produces such a large flux density in any residual ferrous metal that it would bind down on to the primary and impede operation of the separator.

Preferably the linear induction motor primary is oriented so as to produce its travelling field of magnetomotive force in a direction inclined at an angle of less than 90° to the direction of movement of the conveyor means and in a sense such as to have a component in the opposite direction to the direction of movement of the conveyor means. The effect of this is to slow down the movement of non-ferrous metals on the conveyor means so that they are subject to the influence of the primary for a longer period of time than non-electrically conductive materials. The effect of this is that, for a particular size of primary, reliable separation can be achieved with the conveyor means running at a faster speed than would be the case if the field of magnetomotive force travelled in a direction perpendicular to the conveying direction. Alternatively, for any particular conveying speed, the width of the primary can be reduced.

According to a further aspect of the present invention the means for feeding the mixture of non-ferromagnetic material on to the conveyor belt comprises screening means to allow only material within predetermined size limits on to the conveyor belt. This means may comprise one or more screens which may be of the vibratory or rotary type.

The power of the linear motor can thus be chosen to induce sufficient flux in pieces of a specified metal to remove these pieces from the belt. Pieces of a denser metal for example though having a large amount of flux induced will not be removed because of their weight and thus the consequent friction forces involved in their movement.

In a further aspect the invention provides a further linear induction motor associated with the conveyor belt at a position downstream from the first linear induction motor means. By operating this further linear induction motor at a frequency and power higher than the first linear induction motor pieces of a denser metal are removed by the second motor. It is thus possible to provide respective receptacles or bins associated with each motor which will collect different types of metal.

One of the problems with a conveyor belt system is that small pieces of a particular metal can often be trapped under for example larger pieces of non-metallic substance for example plastics material. This problem may be alleviated by the above described screening period of time thereby increasing the probability that they will be displaced off the belt before the belt moves them out of range of the motor. This enables either the speed of the belt to be increased or the width of the motors to be reduced as compared with what would be required if the axes of the motors were perpendicular to the direction of movement of the belt.

Figure 4:
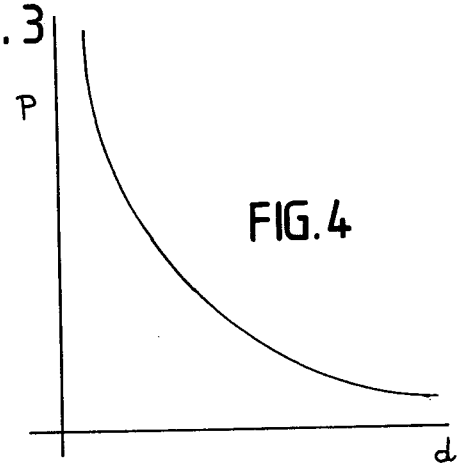

FIG. 4 illustrates the variation of the power P required to cause movement on the conveyor belt 22 of pieces of a particular non-ferromagnetic metal with the smallest dimension d of such pieces. It will be seen that the power P required increases as the dimension d decreases.

It should be realised that the dimension d is the dimension of the material in close proximity to the conveyor belt 22. This is because the flux density falls off exponentially with distance above the surface. Consequently, in order to optimise the use of the available power, the pieces of material are preferably flattened and laid on the belt with their major dimensions perpendicular to the direction of movement of the belt.

Figure 5:
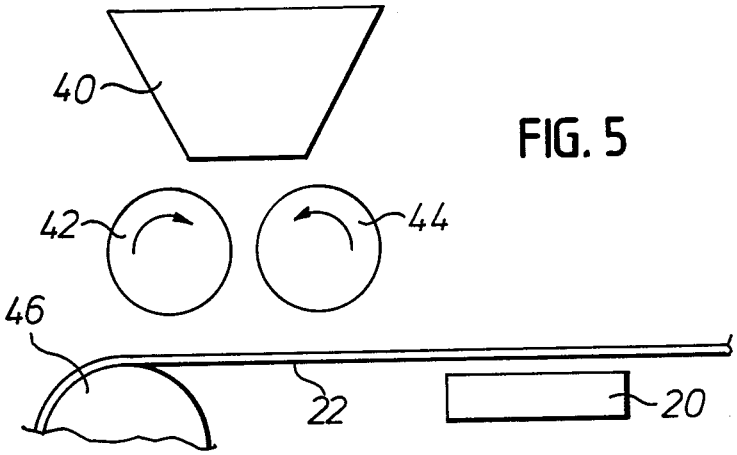

Referring to FIG. 5, the material is preferably fed on to the belt from a hopper 40 with a pair of rolls 42 and 44 disposed between the outlet of the hopper 40 and the belt with their axes parallel to the axis of the driving roller 46 of the belt. Material from the hopper 40 is therefore flattened by the rolls 42 and 44 and deposited on the belt with the major dimension of the various pieces tending to be oriented parallel to the axes of the rolls.

The use of a motor with a relatively short pole pitch enables a large range of sizes of the various pieces of non-ferrous material to be moved in the direction of the travelling field of magnetomotive force. Consequently, it is in general preferable to use a relatively small pole pitch.

Other factors affecting the movement of pieces of non-ferrous material are the density of material, which determines the frictional force which has to be overcome, and the electrical conductivity which determines the magnitude of the induced secondary current for a given flux. When comparing copper and aluminium, the effect of the smaller density of aluminium predominates over that of the higher conductivity of copper with the result that aluminium can be moved at lower field strength than copper. Consequently, if the waste material is segregated into a number of size ranges and the material in each size range fed separately to separating apparatus in accordance with the invention, the field strength of the linear motors 20 and 34 can be arranged to be such that the aluminium pieces are displaced off the belt while copper pieces are allowed to remain on it. If the belt then passes over a further pair of linear motors which are capable of displacing the copper, the latter can then be separately removed from the remaining material. Thus, by using a series of separate pairs of linear motors, different non-ferrous metals can be separated from one another.

One way of increasing the effectiveness of the linear motors is to increase the frequency of the alternating current used to power the motors. For example the motors used to remove the aluminium may be powered at 50 Hz while the motors used to remove the copper may be powered at a higher frequency, up to about 500 Hz. However, the skin effect at the higher frequency has the result of reducing the apparent conductivity of the electrically conductive materials as frequency increases. Since for any particular frequency, skin depth increases as conductivity decreases, this has the effect of compressing the spread of apparent conductivity between different metals. Consequently, it is preferable to use the lowest acceptable frequency and, in particular, to remove medium and large pieces of aluminium using linear motors powered at a relatively low frequency before the conveyor belt passes over motors suitable for the removal of metals whose conductivity or size require a higher frequency.

As previously stated, the cores of the primaries of all linear induction motors for use in accordance with the invention should have a tooth width which is less than 30% of the tooth pitch.

Figure 6:
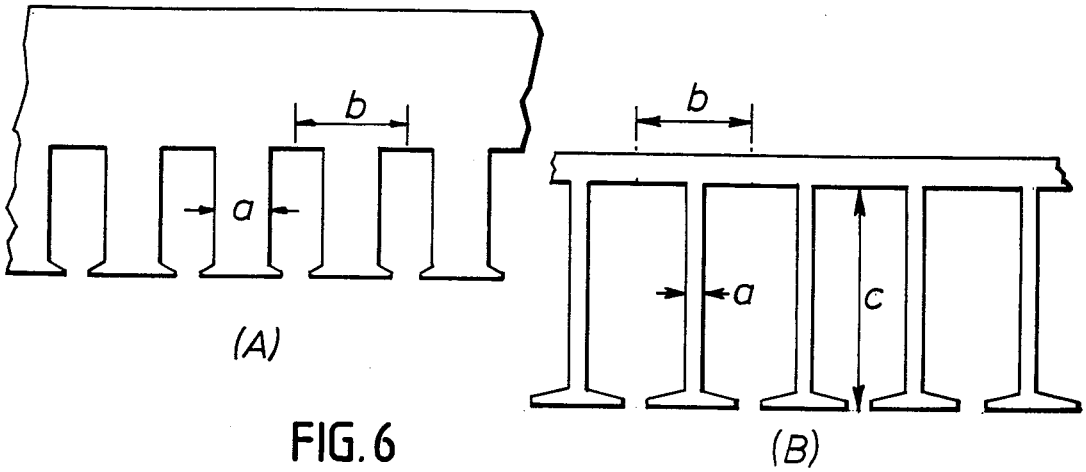
Figure 3:
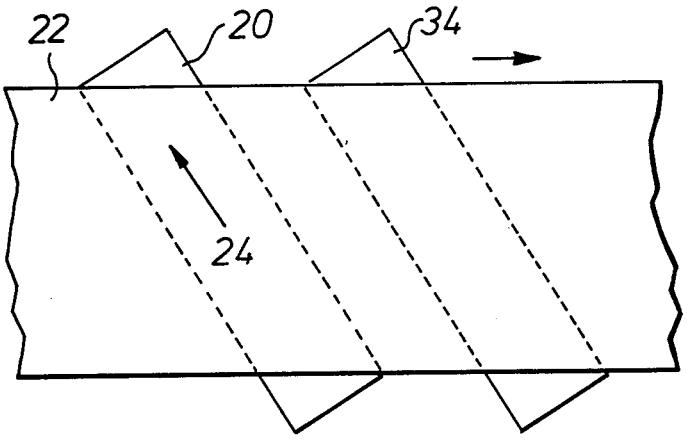

Referring now to FIG. 6 of the drawings FIG. 6A shows the configuration of the stator of a normal type of induction motor. FIG. 6B shows by way of contrast the stator of a linear induction motor suitable for use in the metal sorting system of the present invention.

In the stator of FIG. 6A the tooth width a is approximately half the tooth pitch b but in the stator of FIG. 6B the tooth width a may be seen to be less than 30% of the tooth pitch b. It may also be seen that it is possible to considerably increase the depth c of the slot thus allowing a greater cross section of copper and correspondingly allowing an increase in power of the motor by increased stator current.

Figure 7:
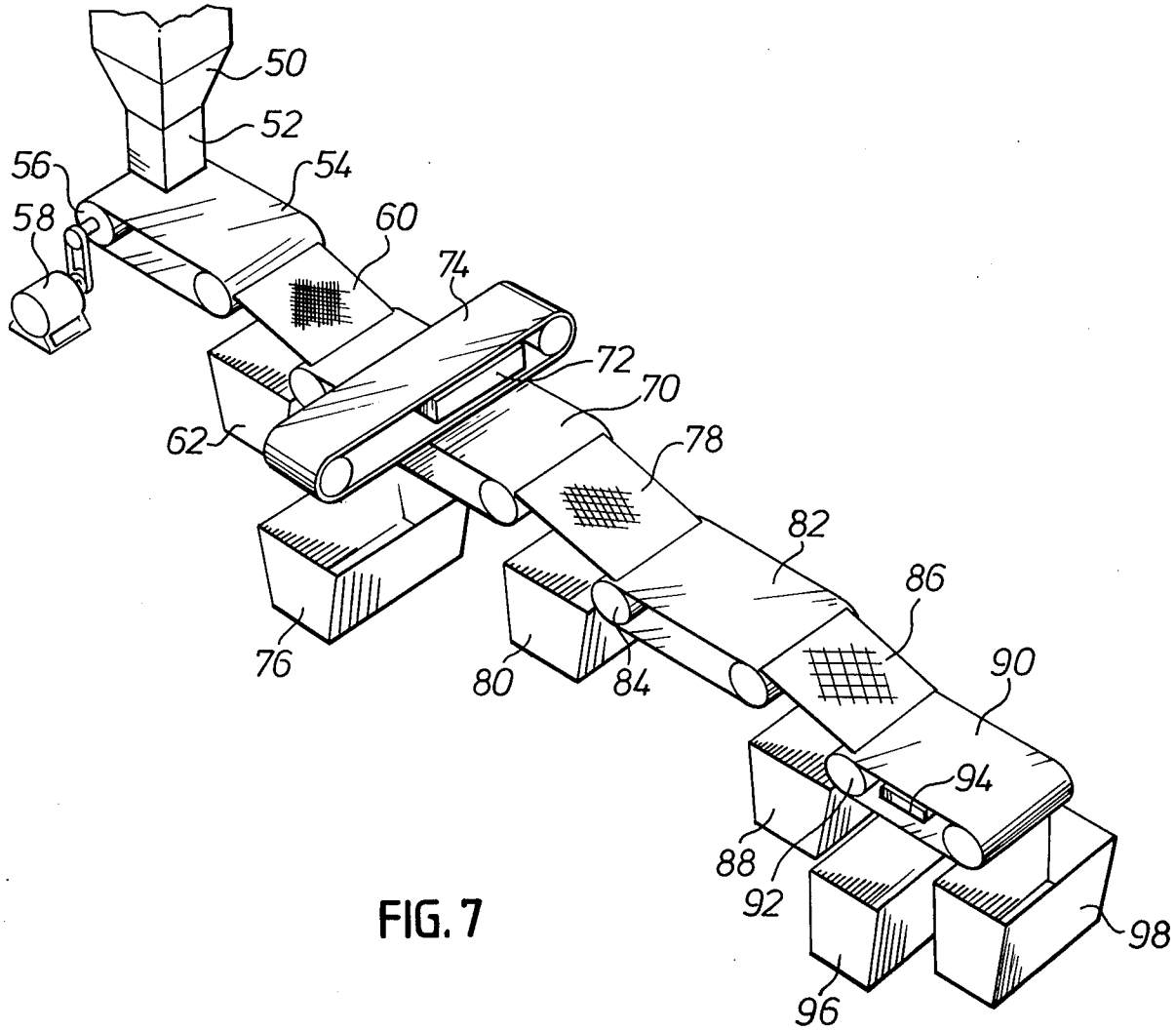

Referring now to FIG. 7 there is shown a first embodiment of a practical metal sorting system. A shredder 50 has an outlet 52 which feeds material both ferrous and non ferrous onto a first conveyor belt 54 driven at a constant predetermined speed by drive roller 56 connected to an electric motor 58.

The material conveyed by the conveyed 54 is deposited on to a first sieve 60 which removes the dust and very small particles from the mixture. The dust is collected by a first hopper 62. As an alternative an air extractor system can be used at this stage. The larger remaining particles are transported by a second conveyor 70 past an overband electromagnet 72 which removes all the ferromagnetic material from the mixture. The ferromagnetic material is attracted by the electromagnet 72 and on to a continuous belt 74 equipped with slats which is wiped across the face of the electromagnet and deposited into a hopper 76.

The material left on the conveyor belt 70 is deposited on to a transfer sieve 78 which removes material below a predetermined dimension from the flow of material. The material falling through the sieve 78 is collected by a hopper 80 and the remaining material is deposited on to a further conveyor 82 driven at a predetermined speed by a drive roller 84. The conveyor 82 deposits the remaining material on to a further transfer sieve 86 which is of large dimension and therefore allows material of larger dimensions to fall into a hopper 88.

It may be seen therefore that if the transfer sieve 78 is a one inch mesh the hopper 80 will contain only material under one inch in any one dimension. If the sieve 86 is a three inch mesh then the hopper 88 will contain material between one and three inches in dimension.

Thus only material over three inches in dimension will be fed onto the last conveyor 90 which is driven by a drive roller 92 at a constant speed over the top of a linear induction motor 94. Material deflected from the conveyor 90 by the motor 94 is collected in a hopper 96 and material left on the conveyor is collected in a last hopper or bin 98.

The linear induction motor 94 is arranged with respect to the conveyor in a manner as described with reference to the preceding FIGS. 1 to 6. The frequency of operation of the motor 94 and the power input to the motor may be chosen to remove the larger pieces of non-ferromagnetic material which are the only sizes left on the conveyor after the two sieving operations.

The contents of each of the hoppers 80 and 88 may subsequently be fed to respective conveyor belt and linear motor systems. The frequency and power of the linear motors are chosen to suit the removal of the appropriate sizes of non-ferromagnetic material in these respective hoppers.

Figure 8:
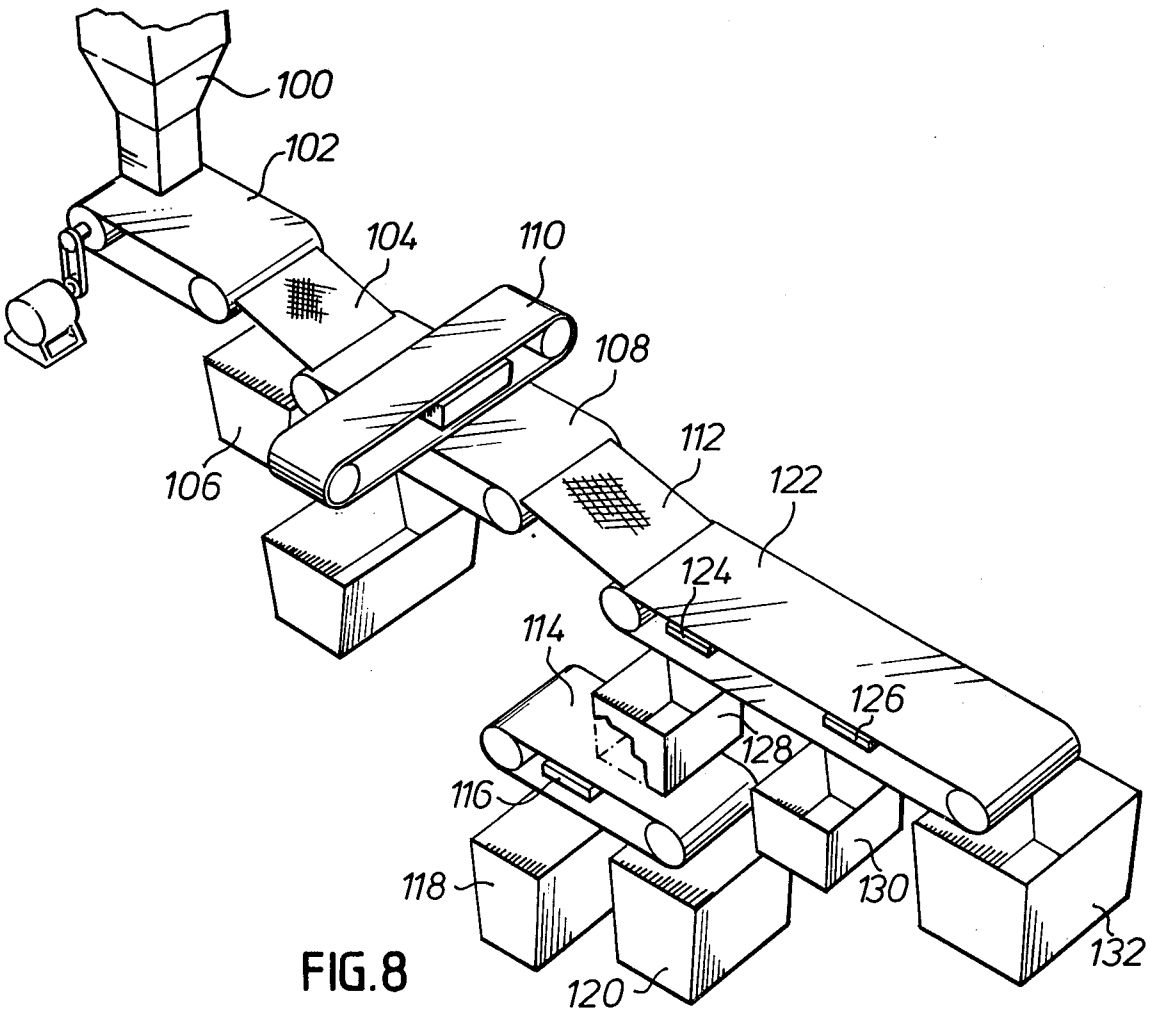

Referring now to FIG. 8 there is shown a second metal sorting system according to the present invention. Material to be sorted is fed as for the system of FIG. 7 into a shredder 100 where it is smashed into relatively small pieces. These are transported by a conveyor 102 onto a dust sieve 104, the dust being collected in a hopper 106. As above alternatively an air extraction system to remove the dust and light material may be used. The rest of the material is conveyed on a conveyor belt 108 past a rotary electromagnet 110 which removes the ferromagnetic material.

Material left on conveyor belt 108 is carried on to a transfer sieve 112 which is of relatively small mesh. Material of all types, such as metal, rubber and plastics falls on to a secondary conveyor belt 114, which moves at a constant predetermined speed in the direction shown. A linear induction motor 116 is mounted beneath the belt and when actuated causes the non-ferromagnetic metal on the conveyor to be deflected sideways off the conveyor to be collected in a hopper 118. Material such as plastics and rubber remaining on the conveyor is collected in a further hopper 120.

Material too large for the sieve 112 is fed to a conveyor belt 122 underneath which are mounted two linear induction motors 124 and 126, motor 126 being downstream from motor 124. Non-ferromagnetic material on the belt is deflected by the first motor 124 into a hopper 128 and by the second motor 126 into a hopper 130. Material left on the conveyor is collected by a hopper 132.

The system of FIG. 8 operates by separating at the sieve 112 the smaller pieces of non-ferromagnetic material and small pieces of plastics and rubber. The non-ferromagnetic material is separated from the rest by the relatively low power linear motor 116.

The larger pieces of material fed on to the conveyor 122 are fed to the linear motor 124 which is operated at a lower power than the motor 116. This motor therefore for example separates all the aluminium from the mixture. The remainder of the material is fed to the second linear induction motor 126 which is operated at a higher power and which thereby deflects the heavier metals such as brass, copper from the conveyor.

Thus by sieving and feeding the material to a series of linear induction motors the non-ferromagnetic metals can be sorted into their various types.

Figure 9:
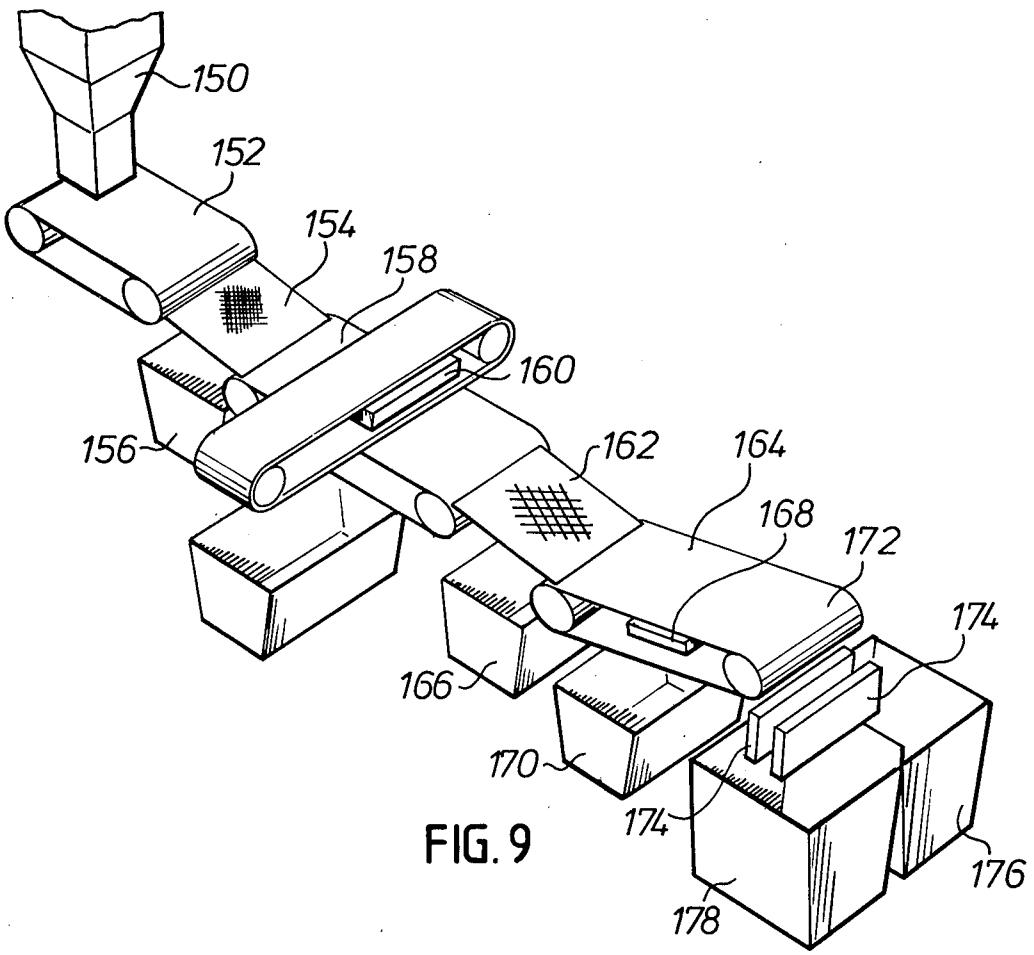

A further system utilising the principles of the present invention is shown in FIG. 9. Again the material such as a motor car or part thereof is fed into a shredder 150 the output material from which is fed via a conveyor 152 to a dust sieve 154 of fine mesh. The dust is collected in a hopper or bin 156. Material not passing through the sieve is passed to a conveyor belt 158 and ferromagnetic material is removed by an overband electromagnet 160.

The remaining material comprising non-ferromagnetic metal, rubber, plastics, etc., is fed via a small mesh sieve 162 to a conveyor 164. Material falling through the sieve 162 is collected in a hopper 166. The sieve 162 can merely be a further dust sieve to remove dust created by the removal of the ferromagnetic material or very small particles. Alternatively as in the arrangement of FIG. 8 it can be of a mesh size to remove the relatively smaller pieces of material.

Material on the conveyor belt 164 is fed past at least one linear motor 168 and the non-ferromagnetic metal deflected by this motor is collected in a hopper 170. As in the arrangement shown in FIG. 8 a second linear induction motor could be situated downstream from the motor 168 to sort out other sizes or types of non-ferromagnetic metal.

The conveyor belt 164 is inclined so that material passing the motor 168 and deflected by it may be assisted by rolling or sliding down the conveyor belt when lifted by the motor thus spending a greater period of time in the field of the motor. This can allow a lower power motor to be used relative to the size of non-ferromagnetic metal to be deflected.

Material left on the conveyor after the motor 168 is moved to the end of the conveyor 172 and dropped in a free fall between a double sided primary linear induction motor 174. It may be seen that the larger pieces of conductive material are deflected into a first hopper 176 and the rest of the material is collected by a hopper 178 situated vertically below the end of the belt 172.

Figure 10:
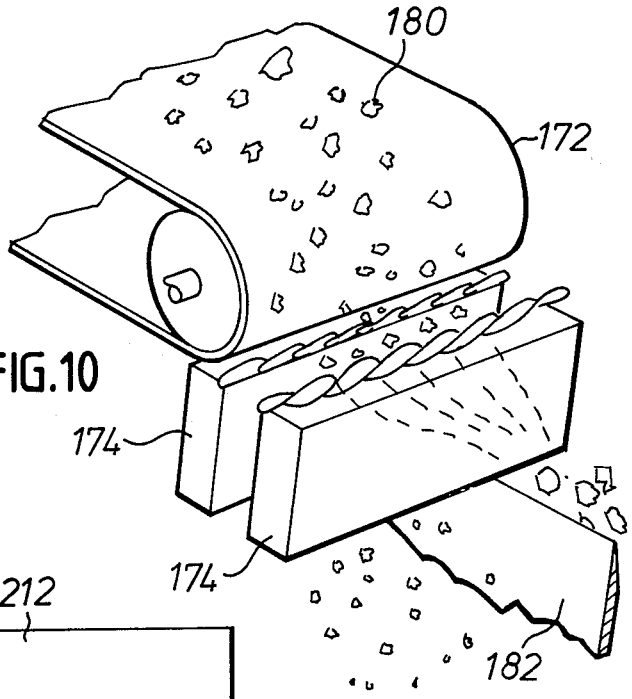

The movement of the conductive material can be to the right as illustrated in FIG. 10. The conductive material 180 falling between the poles of the double sided motor 174 is deflected to the right past a baffle 182 and is directed by the baffle to a hopper (not shown).

The use of a double sided primary as shown in FIGS. 9 and 10 increases the detection sensitivity because the field between the primaries is substantially greater than with an open single primary. The friction of the belt is also eliminated by this system and also the pieces of material are more freely dispersed than on the conveyor where pieces may impede each others movement.

The design of each linear induction motor is important and the deflecting power of any motor depends on a number of factors including principally the design of the stator, the frequency of operation and the motor current. The motors in general however require large operating currents and this results in a considerable heating problem. To obtain the correct operating currents it has been found preferable to water cool the motor. This is accomplished by using hollow copper tubes for the windings and forcing water through the tubes to provide the necessary cooling.

Figure 11:
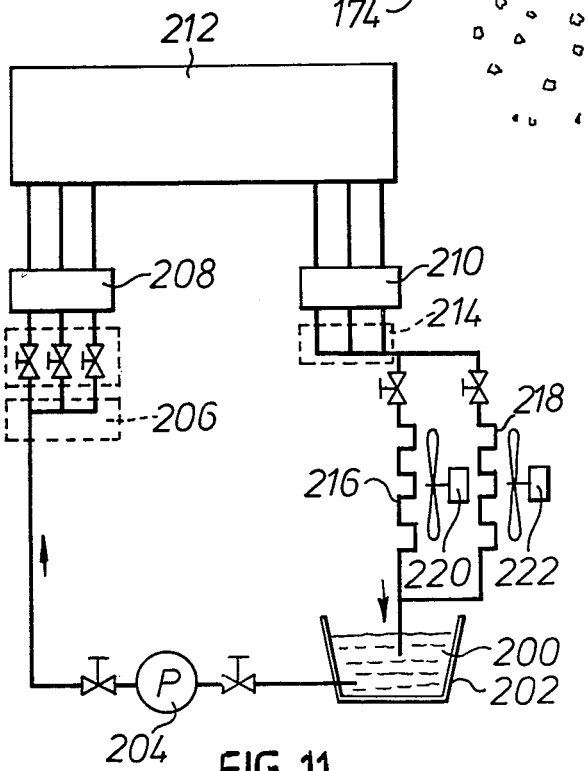

A suitable cooling system is shown in FIG. 11 in which water 200 is stored in a tank 202. A motor driven pump 204 circulates the water round the system in the direction shown back to the tank 200. The flow is split at 206 into three paths to supply each phase of the three phase linear induction motor. Each path has a respective air purge gate and has electrical isolation means 208, 210 on each side of the motor 212. The flow is recombined at 214 and is fed via radiators 216, 218 cooled by electric fans 220, 222 back to the tank 202. Numerous isolation valves are provided as shown.

Figure 12:
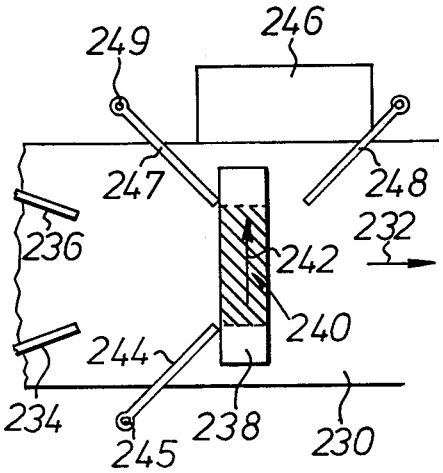

The linear induction motor may not always be of the same width as the conveyor especially if the sorting system is added to an existing installation. FIG. 12 shows a solution to this problem. A conveyor 230 is moved in a direction indicated by arrow 232 by known conveyor drive means (not shown). Material is introduced onto the centre portion of the conveyor by baffles 234, 236. The linear induction motor 238 has a full travelling field zone 240 as shown shaded. The travelling field is in the direction shown by arrow 242. Deflectors 244 and 247, pivoted on pivots 245, 249 are adjusted and then fixed to push any material towards the centre of the conveyor belt 230. The non-ferromagnetic scrap deflected by the motor 238 is either ejected directly into a hopper 246 or in the case of heavier or less conductive pieces onto a collector deflector 248 which guides the material into the hopper 246.

Material fed onto any of the above described conveyor belt and linear motor systems is preferably fed by a vibratory arrangement which effectively spreads the material on the conveyor and stabilises the load on the conveyor. As an alternative the conveyor can be run at a relatively high speed with respect to any immediately upstream conveyors to spread out the material.

In linear motors used in the above described systems a preferred pole pitch was of the order of 2" and an operating frequency of 50/60 Hz was used to remove aluminium. The current in the primary was 2000 amps at 18 volts line. For removal of denser metals higher frequencies of 50–500 Hz will be required.

I claim:

1. A metal sorting system comprising:

means for feeding a mixture of non-ferromagnetic material onto a conveyor belt at a first position, and drive means for said conveyor belt to move said conveyor belt at a predetermined speed in a first direction;

linear induction motor means situated at a second position along said conveyor belt, said second position being intermediate said first position and the end of the conveyor belt;

said linear induction motor means being positioned with the faces of the motor poles adjacent to and substantially underneath said conveyor belt and orientated with respect to said conveyor belt to produce when actuated a field of magnetomotive force in which the lines of force are at right angles to said first direction;

electrical drive means for said linear induction motor means for providing an alternating current supply to said motor means at a power level and with a frequency to force, by means of the traveling wave of magnetomotive force produced by said linear motor means, a percentage of said non-ferromagnetic material from said conveyor belt;

a first reception means situated adjacent said linear motor means on a side of said conveyor belt for receiving non-ferromagnetic material forced from said conveyor belt by the magnetomotive force of said linear motor means in the direction of travel of the magnetic field when actuated;

second reception means situated adjacent said conveyor belt at a position downstream from said linear motor induction means for reception of the material remaining on said conveyor belt;

third reception means situated adjacent said linear motor means on the side of said conveyor belt opposite to said first reception means, for receiving non-ferromagnetic material forced from the conveyor belt by the magnetomotive force of said linear motor means in the opposite direction to the travel of the magnetic field when actuated; and said means for feeding a mixture of non-ferromagnetic material onto said conveyor belt comprising means to allow only material within predetermined size limits onto said conveyor belt.

2. A metal sorting system as claimed in claim 1 in which the linear induction motor means primary member has a toothed core in which the width of each tooth is less than 30% of the tooth pitch.

3. A metal sorting system as claimed in claim 1 in which said means for feeding a mixture of non-ferromagnetic material on to said conveyor belt further comprises an electromagnet for extracting any pieces of ferromagnetic material from an initial mixture of material and further means for removal of small pieces below a predetermined size.

4. A metal sorting system as claimed in claim 1 in which a further linear induction motor means is associated with said conveyor belt at a position downstream from said first linear induction motor means and in which in operation said first linear induction motor means is operated at a frequency and power to remove a selected portion of said non-ferromagnetic material from said conveyor belt and said second linear induction motor means is operated at a frequency and power to remove a further selected portion from the remaining non-ferromagnetic material.

5. A metal sorting system as claimed in claim 4 in which the further linear motor induction means is located underneath the conveyor belt and in which fourth reception means is provided adjacent said conveyor belt for reception of material forced from said conveyor belt by said second linear induction motor means.

6. A metal sorting system as claimed in claim 4 in which the further linear induction motor means is mounted adjacent the end of the conveyor belt in a position vertically below the end of the conveyor belt such that non-magnetic material remaining on said conveyor belt after removal of a portion of said material by said first linear induction motor means falls freely past said further linear induction motor means, fourth reception means situated substantially vertically below the end of said conveyor belt and fifth reception means situated to one side of the fourth reception means in a position to receive material deflected by said further linear induction motor means when energised.

7. A metal sorting system as claimed in claim 6 in which the further linear induction motor means is a double sided linear induction motor and in which the material falls between the two halves.

8. A metal sorting system as claimed in claim 7 in which a deflector plate is situated adjacent said further linear induction motor means to direct the material deflected by the motor into an associated hopper.

9. A metal sorting system as claimed in claim 1 in which the width of the linear induction motor means is substantially less than the width of the conveyor and including deflector means situated upstream from the linear induction motor means to confine the passage of material to the width of conveyor belt covered by the linear induction motor means.

10. A metal sorting system as claimed in claim 1 in which the conveyor belt is installed so as to be along its length at an angle with respect to the horizontal.

11. A metal sorting system as claimed in claim 1 in which the linear induction motor means is water cooled.

12. A metal sorting system as claimed in claim 1 in which the linear induction motor means is positioned such that the axis of the motor means is at an angle with respect to the conveyor belt.

13. A system as in claim 1, wherein:

the mixture of non-ferromagnetic material fed into the system may include different kinds and sizes of metals such that the magnetomotive force exerted on a piece of one metal of a first size may be not materially different from the magnetomotive force exerted on a piece of a different metal of another size; and said material size limiting means is operative to allow on said conveyor belt only those pieces between a certain minimum size and maximum size chosen so that materially different magnetomotive forces are exerted on pieces of different non-ferromagnetic metals to force only pieces of a selected non-ferromagnetic material from said conveyor belt.

14. A metal sorting system including means for feeding a mixture of non-ferromagnetic material on to a conveyor belt at a first position, drive means for said conveyor belt to move said conveyor belt at a predetermined speed in a first direction;

linear induction motor means situated at a second position along said conveyor belt, said second position being intermediate said first position and the end of the conveyor belt;

said linear induction motor means being positioned with the faces of the motor poles adjacent to and substantially underneath said conveyor belt and orientated with respect to said conveyor belt to produce when actuated a field of magnetomotive force in which the lines of force are at right angles to said first direction;

electrical drive means for said linear induction motor means for providing an alternating current supply to said motor means at a power level and with a frequency to force, by means of the traveling wave of magnetomotive force produced by said linear motor means, a percentage of said non-ferromagnetic material from said conveyor belt;

first reception means situated adjacent said linear motor means on a side of said conveyor belt for receiving non-ferromagnetic material forced from said conveyor belt by the magnetomotive force of said linear motor means in the direction of travel of the magnetic field when actuated;

second reception means situated adjacent said conveyor belt at a position downstream from said linear motor induction means for reception of the material remaining on said conveyor belt;

third reception means situated adjacent said linear motor means on the side of said conveyor belt opposite to said first reception means, for receiving non-ferromagnetic material forced from the conveyor belt by the magnetomotive force of said linear motor means in the opposite direction to the travel of the magnetic field when actuated; and said means for feeding a mixture of non-ferromagnetic material onto the conveyor belt including means for flattening the pieces of material before arriving at said second location, so as to increase the surface area of flattened non-ferromagnetic metals and thus to place a greater mass of such metals within the field of magnetomotive force.

* * * * *